United States Patent [19]

Niestrath et al.

[11] Patent Number: 4,848,630

[45] Date of Patent: Jul. 18, 1989

[54] METHOD AND APPARATUS FOR POSITIONING A WEB OF MATERIAL IN STEPWISE TRANSPORATION THEREOF

[75] Inventors: Hans D. Niestrath, Enger; Wilfried Kammann, Bünde, both of Fed. Rep. of Germany

[73] Assignee: Werner Kammann Maschinenfabrik GmbH, Bunde, Fed. Rep. of Germany

[21] Appl. No.: 939,987

[22] Filed: Dec. 10, 1986

[30] Foreign Application Priority Data

Dec. 12, 1985 [DE] Fed. Rep. of Germany ..... 3543846

[51] Int. Cl.[4] ..... B65H 23/22; B65H 20/24

[52] U.S. Cl. ..... 226/4; 226/8; 226/24; 226/44; 226/108; 226/111; 226/115

[58] Field of Search ..... 226/4, 24, 115, 28, 226/108, 111, 120, 122, 134, 136, 138, 118

[56] References Cited

U.S. PATENT DOCUMENTS

| | | | |
|---|---|---|---|
| 3,525,858 | 8/1970 | Thiede et al. | 226/28 X |
| 3,561,654 | 2/1971 | Greiner | 226/111 X |
| 3,613,975 | 10/1971 | Knight | 226/111 X |
| 3,887,122 | 6/1975 | Sommerig | 226/136 |
| 4,264,957 | 4/1981 | Pautzke | 226/28 X |
| 4,316,566 | 2/1982 | Arleth et al. | 226/2 |
| 4,648,539 | 3/1987 | Dingerkus | 226/21 X |

FOREIGN PATENT DOCUMENTS

| | | |
|---|---|---|
| 2633999 | 9/1978 | Fed. Rep. of Germany . |
| 3020847 | 3/1981 | Fed. Rep. of Germany . |

*Primary Examiner*—Stuart S. Levy
*Assistant Examiner*—Katherine Matecki
*Attorney, Agent, or Firm*—Seidel, Gonda, Lavorgna & Monaco

[57] ABSTRACT

For accurate positioning of a web of material which is to be transported stepwise by at least first and second feed means through processing stations disposed therebetween, the feed means are controlled by a programmable computer which stores a value representative of the length of the distance to be covered by the web during a transportation step. The tension of the web is measured and the measured value is compared to a reference value stored in the computer. If the actual value deviates from the reference value the drive means of at least one of the web feed means is controlled in such a way that the tension in the web is at least substantially adjusted to the reference value by increasing or reducing the length of the portion of web which in a transportation step is drawn into the processing region between the web feed means.

9 Claims, 3 Drawing Sheets

METHOD AND APPARATUS FOR POSITIONING A WEB OF MATERIAL IN STEPWISE TRANSPORATION THEREOF

BACKGROUND OF THE INVENTION

The invention relates generally to a method and apparatus for positioning a web of material which is to be transported in a stepwise manner by means of at least two forward feed means through processing stations disposed between the feed means. Such a procedure is involved for example in printing on webs of material which are fed through printing stations and possibility for separating the individual printed images or areas produced on the web of material, for example by means of a stamping operation.

In one form of such a method, the length of the distance to be covered by the web of material during one transportation step is stored in a programmable computer which is operable to control the forward feed means. Thus the effective length of the distances to be covered in each transportation step by the web of material are detected by way of an opto-electronic detector arrangement and compared as an actual value to the reference value stored in the computer. In the event of a deviation between the actual value and the reference value, a correction operation is carried out in order to match the actual value to the reference value, independently of matching or register marks which may be provided on the web of material. However, such a method is frequently no longer adequate for the levels of precision which are required nowadays and which require a degree of accuracy of less than 0.1 mm, possibly even only 0.01 mm, with a register length, that is to say the distance to be covered by the web of material in each transportation step, for example of 1 m.

An essential requirement in regard to attaining the aboveindicated level of accuracy required is that the tension of the web of material in the portion thereof which is between the first and second forward feed means is to be as constant as possible in order to minimise variations in the length of that portion of material, due to shrinkage or elongation thereof. As will be appreciated, such variations in length will affect the length of the printed image or pattern applied to the web of material. It will be further appreciated that when printing is applied to the web in a plurality of printing operations in a corresponding number of printing stations in which for example printed images of different colours are successively applied to the web, thus making up the complete printed image, it is also necessary to ensure that each portion of the web to which printing is to be applied is of the same length in all the successive printing operations or printing stations, in order to achieve the required level of accuracy. That same consideration also applies in regard to a severing or cutting station if such is provided, in which the printed portion of web is cut away from the remainder of the web, for example by means of stamping blades. If the above-indicated requirement is not met, the position of the actual severing cut which severs the printed portion of the web from the remainder thereof would deviate at least in part from the desired or reference position thereof.

SUMMARY OF THE INVENTION

An object of the present invention is to provide a method of controlling the feed of a web of material through processing stations, which provides for improved positioning of the web of material in relation to the respective processing stations.

Another object of the present invention is to provide a method of positioning a web of material to be transported intermittently through processing stations, such that a higher degree of accuracy in respect of positioning of respective portions of the web of material relative to each of the processing stations can be achieved.

Yet another object of the present invention is to provide a method of controlling a feed of a web of material through processing stations in which the web is to be printed, such that there are at least substantially reduced variations in the dimensions of each printed image produced from one processing station to another, such that the quality of the end product is not impaired.

A further object of the present invention is to provide an apparatus for positioning a web of material to be transported intermittently through a plurality of processing stations, which affords better control in respect of positioning of the web in the respective stations.

Still a further object of the present invention is to provide an apparatus for correctly positioning a web of material which is to be advanced stepwise through a plurality of printing stations, in such a way as to provide improved register of printed images on the web in each of the stations.

In accordance with the teachings of the present invention, in a first aspect, these and other objects are achieved by a method of positioning a web of material which is to be transported in a stepwise manner by means of at least first and second forward feed means through processing stations disposed between the forward feed means, wherein the forward feed means are controlled by a programmable computer. The computer stores the desired or reference value in respect of the length of the distance to be covered by the web of material during a respective transportation step. The tension in the web is measured and that measured value is compared to a stored reference value. In the event of the actual value deviating from the reference value by at least a predetermined amount, the drive means of at least one of the forward feed means is influenced in such a way that the tension in the web is at least approximated to the reference value thereof by increasing or reducing the length of the portion of the web of material which in each transportation step is moved into the region between the forward feed means.

In another aspect, the invention provides an apparatus for positioning a web of material which is to be transported stepwise through a plurality of processing stations, comprising first and second forward feed means of which one is arranged at the entry end of the feed path for the web of material and the other is arranged at the discharge end thereof, and a programmable computer for controlling the first and second forward feed means and for storing a value corresponding to the length of the distance covered by a respective portion of the web of material during a transportation step. The apparatus further includes at least one means for measuring the tension in the web of material in the feed path thereof, and means for controlling at least one of the first and second feed means in dependence on the measured tension of the web of material, thereby to keep said tension at an at least substantially constant value.

In a preferred feature of the method of the invention, the tension in the web is measured in the period between two successive transportation steps. In the event of the actual value deviating from the reference value by more than a predetermined amount, the drive means of at least one of the feed means is correspondingly influenced in the next transportation step, to restore the actual tension in the web to the required value. Thus for example, if the tension in the web should fall, then the drive means of the forward feed means is adjusted in such a way that the web is drawn out of the machine by a greater distance than corresponds to the length of the portion of web which is introduced into the machine at the entry end of the feed path of the web of material through the machine. It is possible for the drive means which is thus adjusted to be the drive means for the feed means at the entry end of the feed path of the web of material or the drive means of the feed means at the discharge end of the feed path. It is also possible for both of the forward feed means to be suitably adjusted in order to bring the actual value of the tension in the web of material to the reference value thereof; for example, if the actual value of the web tension is lower than the reference value, then in order to make the necessary change in tension in order to increase same, the distance by which the web of material is drawn out of the machine at the discharge end thereof, or in other words, the length of the portion of web of material which is pulled out of the discharge end of the machine, is increased, and at the same time the length of the portion of web of material which is fed into the machine at the entry end thereof is reduced. That has the advantage that the change in the tension of the web which is caused by such adjustments to the first and second forward feed means is more uniformly distributed over the entire length of the web, insofar as the web tension is adjusted from both ends of the web feed path.

If on the other hand the actual value of the tension in the web is equal to the reference value thereof or differs therefrom only to such a slight degree that there is no need to modify the web tension, then the first and second forward feed means continue to operate synchronously.

In accordance with a further preferred feature of the invention, in order to increase the degree of accuracy with which the web of material is positioned at the end of each transportation step, the distance covered by the web of material is detected during the transportation step. A comparison is then made in the computer between the detected actual value and the reference value stored in the computer in respect of the distance to be covered by the web and the speed cycle or operating procedure in respect of speed over the distance of a transportation step, that is to say the speed and variations therein over said distance, as will be referred to in greater detail hereinafter. If the actual value deviates from the reference value, the speed operating procedure is then altered in dependence on the distance actually covered by the web of material. That procedure is based on the consideration that, in order to achieve the necessary level of accuracy, it is necessary to regulate the speed operation procedure in dependence on the distance covered by the web of material in each transportation step, that is to say the register or format length. Thus, first of all, the computer receives a reference value in respect of the speed operating procedure which, taking account of the time available for a transportation step, combines the acceleration phase at the beginning of each transportation step and the deceleration phase at the end of each transportation step with a phase which may occur between the acceleration and deceleration phases and which involves a constant speed of movement of the web, to provide the optimum speed operating procedure in a given transportation step. However the level of accuracy in that procedure, which can be theoretically achieved in that manner, can hardly be attained in a practical situation as the drive means, for example motors, which produce the forward feed movement of the web, operate with small but inevitable irregularities which make it impossible to fix the respective distance covered by the web of material in a transportation step, by way of the speed operating procedure. In accordance with an additional feature of the invention therefore, the method provides that the programmed speed operating procedure in the computer is additionally influenced by the result of the operation of detecting the distance covered by the web of material, in such a way that, if necessary, in dependence on the actual distance covered, deceleration of the web of material down to a stopped condition is adapted to the conditions actually prevailing, deviating therefore from the programmed value. Such adaptation in the rate of deceleration normally occurs in the last part of the deceleration phase. The stepwise transportation movement of the web which is achieved with a very high degree of precision in that way provides that the length of the portion of web which is transported into the region between the entry end and the discharge end of the web feed path in a respective transportation step remains at as constant a value as possible so that changes in the web tension due to transportation steps differing in regard to the length thereof can be avoided or at any event minimised to such a degree that they are no longer significant. In other words, any changes in web tension which may occur are only to be attributed to a varying modulus of elasticity over the length of the web, temperature factors, humidity factors and other factors which are independent of the way in which the transportation steps are carried out.

Further objects, features and advantages of the present invention will be more clearly apparent from a detailed description of a preferred embodiment thereof.

DESCRIPTION OF THE PREFERRED EMBODIMENT

Figure 1:
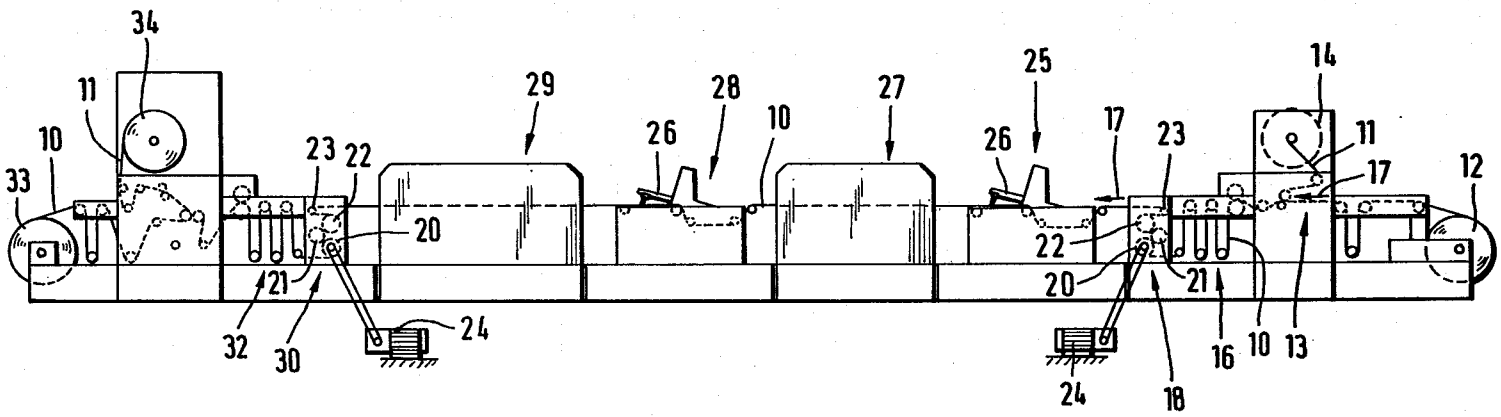
FIG. 1 is a diagrammatic side view of a screen printing machine for printing on material in web form.

Referring firstly to FIG. 1, illustrated therein is an apparatus in the form of a screen printing machine, which includes an arrangement for positioning the web of material which is to be transported therethrough in a step-wise manner, to pass successively through processing stations in the form of printing stations, to which more detailed reference will be made hereinafter.

Thus, reference numeral 10 denotes the web of material which is to be printed while reference numeral 11 denotes a protective overlay which is also in strip form and which is disposed on the side of the web 10 which is to be provided with the printed image or other printed matter. The web 10 with the protective overlay 11 is drawn from a supply roll 12 and passed into a first station 13 in which the protective overlay 11 is removed therefrom. After removal, the protective overlay 11 is rolled on to a take up roll 14 which is suitably disposed in the station 13.

From the station 13, moving in the direction of forward feed movement as indicated by the arrows 17, the web 10, now without the protective overlay 11, passes into a dancer roller mechanism 16 which is provided with a plurality of displaceably mounted rollers and which serves in conventional manner to compensate for the different speeds of forward feed movement of the web 10 in the direction indicated by the arrows 17, upstream and downstream of the dancer mechanism 16 respectively. The web 10 is continuously drawn from the roll 12 whereas it is advanced in the direction 17 in a stepwise manner downstream of the dancer mechanism 16.

From the dancer mechanism 16, the web 10 passes into a first forward feed means 18 which comprises a drive roller 20 and additional guide and direction-changing rollers or drums 21, 22 and 23. The drive roller 20 is suitably driven by a d.c. motor as indicated at 24.

Disposed downstream of the first feed means 18 in relation to the direction of forward feed movement as indicated by 17 is a first screen printing station 25 in which a first printed image is applied to the web 10 using a printing screen 26 and other conventional means which are not shown in the drawings such as for example a squeegee and counterpressure roller. From the first screen printing station 25, the portion of the web 10 which is provided with the first portion of printed matter therein, in the next following transportation step, passes into a first drying station 27 in which the printing ink applied in the first screen printing station 25 is dried at least to such an extent that a second printed image or portion of printed matter can be applied to the web of material at the location of the first printed image, in the second screen printing station 28. It will be seen therefore that the corresponding portion of the web 10 is moved from the drying station 27 into the second screen printing station 28, in one of the following transportation steps. Arranged downstream of the second screen printing station 28 is a second drying station 29 in which the printing ink applied in the second screen printing station 28 is dried, before the respective portion of the web 10 moves in the next following transportation step into the region of the second forward feed means 30. The feed means 30 also comprises a drive drum 20 as well as guide and directionchanging drums or rollers 21, 22 and 23 which are arranged in mirror image relationship to the corresponding drums and rollers of the first forward feed means 18. The drive roller 20 of the second forward feed means 30 is also driven by a d.c. motor 24.

Arranged downstream of the second forward feed means 30, in relation to the direction of forward feed movement of the web of material as indicated at 17, is a second dancer mechanism 32 which is of similar construction to the first dancer mechanism 16 but which operates in the opposite fashion, namely it provides for compensation as between the intermittent transportation movement of the web material 10 between the first and second forward feed means 18 and 30, and the continuous transportation movement of the web 10 between the second dancer mechanism 32 and a storage roll 33 on to which the printed web is wound. Before the web is wound on to the roll 33, another protective overlay 11 which is also in strip form is unwound from a supply roll 34 and applied to the printed web 10.

The longitudinal tension in the web of material 10 is to be kept at a value which is as constant a possible in that region of the apparatus which is to be found between the first and second forward feed means 18 and 30 and which includes the processing stations 25, 27, 28 and 29. For that purpose, in the illustrated embodiment, mounted at the exit or discharge end of that region is a direction-changing roller 23 which forms part of the second forward feed means 30. As can be seen from FIG. 2 to which reference is now additionally made, interposed in the mounting of the roller 23 in a strain gauge strip 36 which is connected to a bridge circuit 37 in such a way that the longitudinal tension in the web 10 can be detected at any suitable time by means of the strain gauge strip 36. Further reference will be made to the bridge circuit 37 hereinafter, in relation to FIG. 3.

Figure 2:
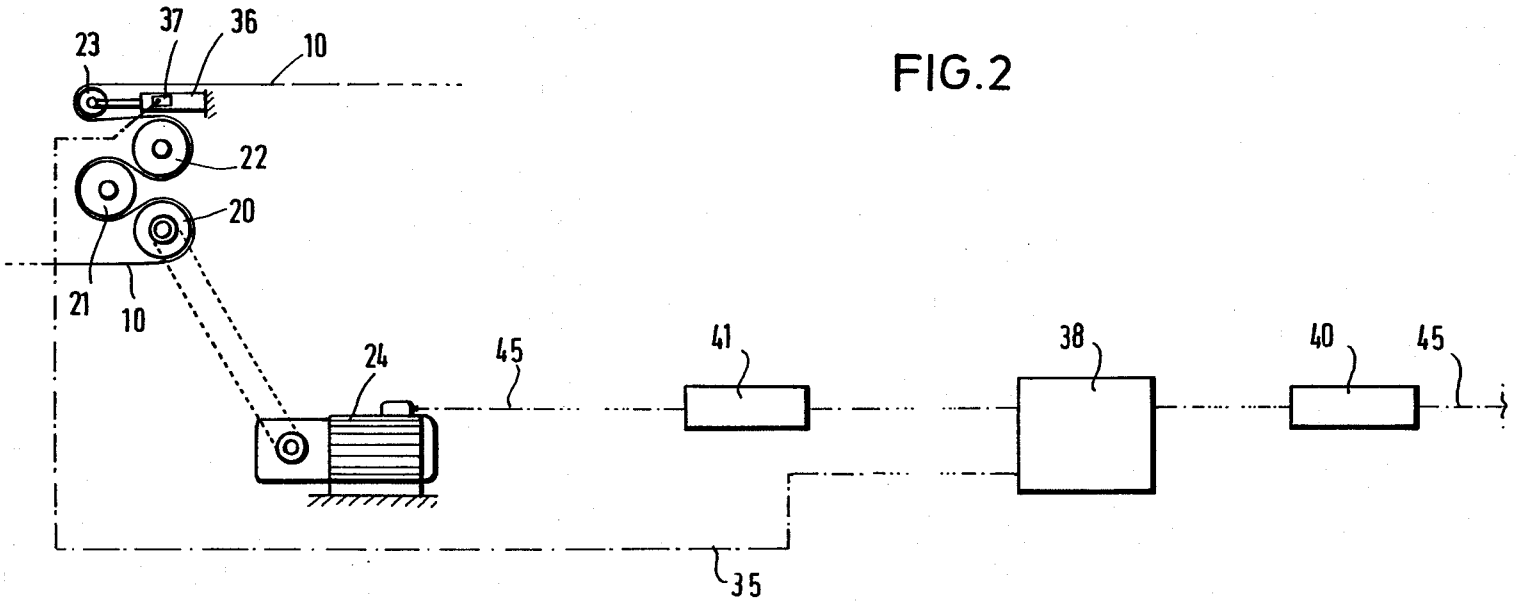
FIG. 2 is a diagrammatic view of a portion of the machine shown in FIG. 1, illustrating the web feed means at the discharge end of the FIG. 1 machine, on a larger scale.

Referring still to FIG. 2, the value of the tension of the web 10 which is detected by the bridge circuit 37, between the entry end of the feed path of the web of material, associated with the first forward feed means 18, and the discharge end of the web feed path, associated with the second forward feed means 30, is passed by way of a line 35 to a main computer 38 into which are also introduced reference values in respect of the web tension, register length, speed operating procedure and thickness of the web material. The reference values in respect of the speed operating procedure in each transportation step relate to acceleration at the beginning of the transportation step, deceleration at the end thereof, and a phase which may occur between the acceleration and deceleration phases, involving a constant speed for the drive motors 24 of the first and second forward feed means 18 and 30 respectively.

Associated with each forward feed means 18 and 30 is a respective computing means 40 and 41 as shown in FIG. 2. Each computing means 40 and 41 receives from the main computer 38 the reference values relating to speed, acceleration, deceleration and register length, and transmits same to a respective DC-chopper 42 and 43 connected on the output side thereof. Each chopper 42, 43, by means of pulse control, controls the respective drive motor 24 connected to the output thereof, to control the output power thereof for driving the respective forward feed means 18 or 30. Also connected between the respective DC-choppers 42 and 43 and the respective drive motors 24 is a conventional current control circuit 50 which is intended to ensure that the respectively associated d.c. motor 24 operates with as low a level of oscillation as possible.

Figure 3:
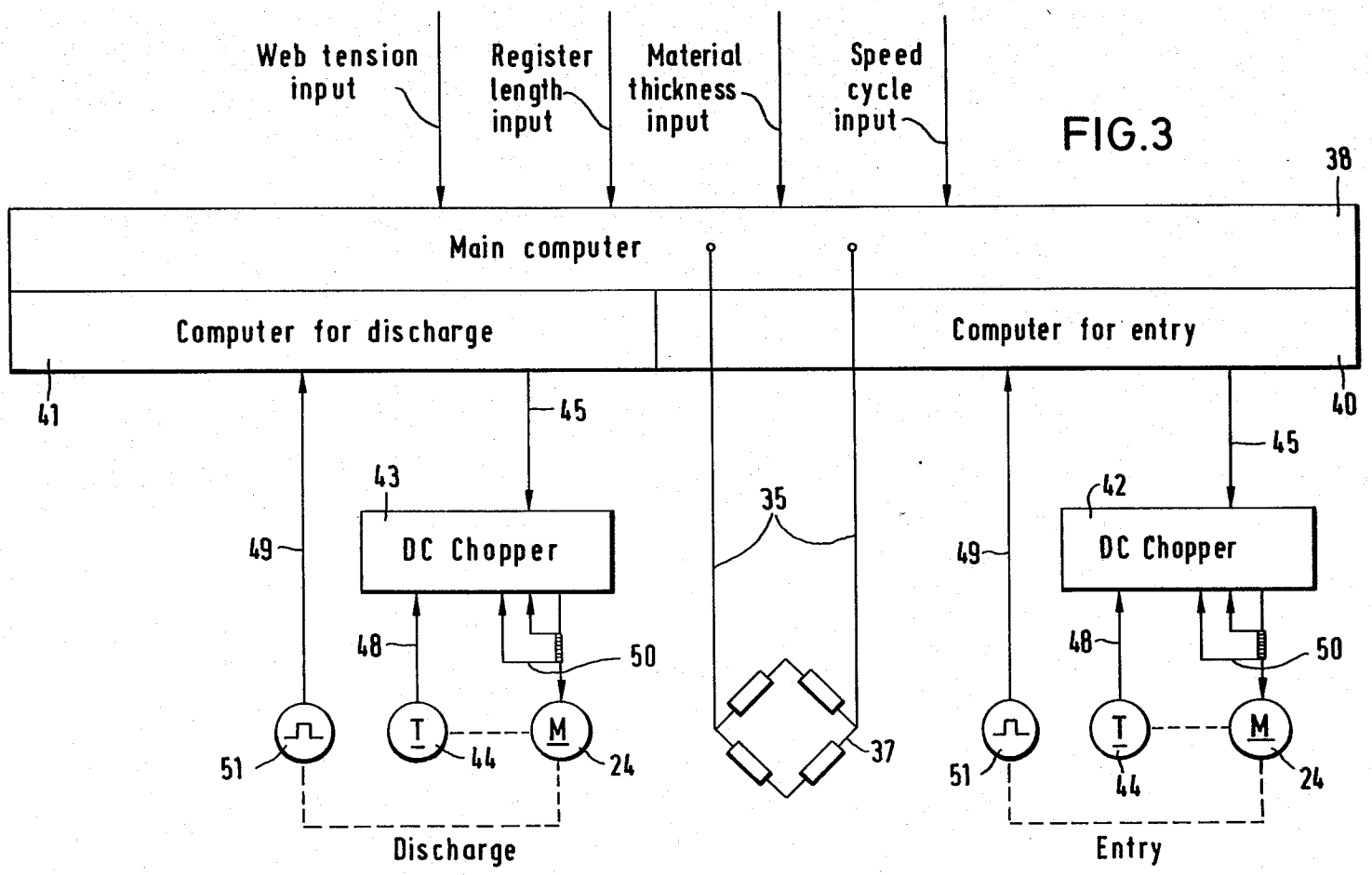
FIG. 3 shows a circuit diagram of the control means for regulating the forward feed movement of the web.

Referring now additionally to FIG. 3, also associated with each drive roller or drum 20 of the feed means 18 and 30 respectively is a rotary detector or synchro 51 and a tachogenerator 44. The synchro 51 measures the angular position of the respective drums or rollers 20, 21 and 22 which are drivingly interconnected, that is to say, it measures the distance covered during rotational movement by the respective drive drums 20, 21 and 22. The tachogenerator 44 measures the speed of the drive drums 20. It represents part of a control circuit which inputs the measured speed by way of a line 48 into the respective DC-chopper 42 and 43 respectively. Therein the actual value in respect of speed is compared to the stored reference value thereof. In the event of a deviation beyond a certain degree, the actual speed value is altered to match it to the reference speed value, by suitably controlling the d.c. motor 24.

The positional signals from the respective synchro 51 pass by way of a line 49 into the respective associated computing means 40 and 41 associated with the entry and discharge ends of the feed path of the web of material. The synchro supplies a given number of pulses, for example 5000 pulses, per revolution. The respective computing means 40 and 41 connected to each synchro 51 measures at given time intervals, for example after each four milliseconds, the number of pulses which have arrived between each two measurement steps, and derives therefrom the distance covered by the web of material and the speed, that is to say, the distance per unit of time. By a comparison operation, the computing means 40 and 41 respectively then ascertain whether the distance covered by the web of material 10 during the transportation movement thereof, in a period up to a given time, corresponds to the corresponding distance which was stored in the main computer as a reference value in respect thereof. If there is a difference between the actual and the reference values, if for example the web 10 has covered a greater distance than would correspond to the stored reference value, then the reference value in respect of speed which has been introduced into the respective computing means 40 and 41 is also altered thereby and the altered reference value is passed by way of the line 45 into the respective DC-chopper which then controls the speed operating procedure on the basis of the fresh reference value. In that way, in each transportation step for the web 10, the predetermined length is actually drawn into the operating region between the entry end of th e feed path of the web of material, namely at the forward feed means 18, and the discharge end, namely the forward feed means 30, thereby avoiding variations in web tension due to variations in the length of the portion of material which is drawn into the operating region between the first and second feed means 18 and 30, that is to say, the register length.

The respective tension in the web 10 between the entry end and the discharge end of the feed path thereof, namely between the forward feed means 18 and 30, is measured between two successive transportation steps by the strain gauge device 36. The result of the measurement operation is transmitted by way of a line 35 to the main computer 38 in which it is compared to the reference value stored therein. If there is a difference between the actual value and the reference value, of greater than a given amount, the main computer 38 outputs a suitable signal to one of the computing means 40 or 41 or possibly both thereof, and that causes suitable correction of the stored reference value of the length of the portion of material which is drawn into the operating region of the machine, by way of respective DC-choppers 42 and/or 43, as appropriate.

The web of material 10 may also be provided with markings which can be detected by opto-electronic or other means and which make it possible at the end of the respective transportation step to detect the position of the portion of web to be printed relative to the respective printing mechanism, in particular the screen printing stencil 26 in the respective printing station. It is possible for the screen printing stencil 26 to be arranged displaceably in the direction of the web of material 10 in such a way that it is aligned with respect to the respective portion of web to be printed, after each transportation step and prior to beginning the printing operation. In that way it is possible without difficulty, in particular in the second and possibly other following printing stations, to provide for precise alignment of the screen printing stencil with respect to the respective printed image or other printed matter applied to the web of material in the respectively preceding station.

In a modification of the embodiment illustrated in the drawings, the tension of the web of material 10 may also be measured at any other position between the two feed means 18 and 30. That shows that the devices required for that operation can also be arranged at any location in the region between the entry and discharge ends of the feed path for the web of material.

It will be appreciated that the above-described method and apparatus have been described solely by way of example of the present invention which is not restricted thereto and that accordingly other variations and modifications may be made therein without thereby departing from the spirit and scope of the present invention.

What is claimed is:

1. A method of positioning a web of material along a feed path between first and second forward feed means comprising the steps of: storing a web tension reference value in a programmable computing means; transporting said web stepwise between said two feed means and maintaining the web stationary between successive transportation steps thereof; measuring the tension in the web between said first and second forward feed means while the web is stationary; comparing the measured value of web tension said web tension reference value stored in the computing means and, when the measured tension value deviates from the tension reference value by at least a given amount, controlling at least one of said feed means to feed the web material a predetermined distance in each transportation step into or out of the region between the two feed means so that the tension in the web between said first and second forward feed means is maintained substantially at said stored reference value when the web is stationary.

2. A method as set forth in claim 1, further comprising the steps of storing said predetermined distance the web is to be fed during a transportation step in said computing means, detecting the actual distance covered by the web of material during a transportation step, comparing the detected distance to the stored predetermined distance, and, when the detected distance deviates from the predetermined distance by at least a given amount, controlling at least one of said forward feed means to vary the speed of the web during a transportation step.

3. A method as set forth in claim 2 wherein said step of transporting the web stepwise includes accelerating and decelerating the web during each transportation step and wherein said step of varying the speed of the web includes altering the web deceleration.

4. Apparatus for positioning a web of material along a feed path between first and second forward feed means comprising: programmable computing means for storing a web tension reference value; means for transporting said web stepwise between said two feed means and for maintaining the web stationary between successive transportation steps thereof; means for measuring the tension in the web between said first and second forward feed means; when the web is stationary; means for comparing the measured value of web tension to said web tension reference value stored in the computing means; said programmable computing means responsive to the comparing means; for controlling at least one of said feed means the length of the web material which in each transportation step is drawn into or out of the region between the two feed means when there is a difference between said measured and reference web tension values so that the tension in the web between said first and second forward feed means is maintained substantially at said stored reference value when the web is stationary.

5. Apparatus as set forth in claim 4 wherein said at least one feed means is disposed at a discharge end of the feed path of said web.

6. Apparatus as set forth in claim 4 wherein said at least one feed means is disposed at an entry end of the feed path of said web.

7. Apparatus as set forth in claim 4 wherein one of said feed means is disposed at an entry end of the feed path of said web and the other of said feed means is disposed at a discharge end of the feed path of said web.

8. Apparatus according to claim 4 wherein said programmable computing means includes means for storing a reference to be covered by the web during a transportation step, and further including means for detecting the actual distance covered by the web during a transportation step, means for comparing the detected distance to the stored reference distance, and means for controlling at least one of said forward feed means to vary the speed of the web during a transportation step when there is a difference between the actual and reference distances.

9. Apparatus according to claim 4 wherein said means for transporting said web stepwise includes means for accelerating and decelerating the web during each transportation step and wherein said means for controlling the speed of the web includes means for altering the deceleration of the web.

* * * * *